US005137272A

United States Patent [19]

Wilkinson

[11] Patent Number: 5,137,272

[45] Date of Patent: Aug. 11, 1992

[54] EXERCISE DEVICE FOR RESISTANCE WALKING

[76] Inventor: William T. Wilkinson, Box 378, Chesapeake City, Md. 21915

[21] Appl. No.: 591,570

[22] Filed: Sep. 26, 1990

[51] Int. Cl.[5] ..... A63B 21/055

[52] U.S. Cl. ..... 482/124; 482/139; 482/74

[58] Field of Search ..... 272/67, 70, 100, 114, 272/135, 139, 133, 142, 143, 138, 903, DIG. 4, DIG. 9; 54/71, 72; 128/80 H, 83.5, 84 A, 101.1, 102.1, 125.1; 119/101, 126, 100, 128

[56] References Cited

U.S. PATENT DOCUMENTS

| | | | |
|---|---|---|---|
| 163,405 | 5/1875 | Pickering | 119/101 |
| 438,360 | 10/1890 | Phelps | 54/72 |
| 444,570 | 1/1891 | Phelps | 54/72 |
| 1,402,179 | 1/1922 | Piscitelli | 272/139 |
| 1,432,013 | 10/1922 | Blake | 272/139 |
| 2,097,376 | 10/1937 | Marshman | 272/139 |
| 2,534,727 | 12/1950 | Moyle | 54/71 |
| 2,613,932 | 10/1952 | Manners | 272/139 |
| 3,162,441 | 12/1964 | Karlik | 272/139 |
| 3,999,752 | 12/1976 | Kupperman et al. | 272/DIG. 4 X |

FOREIGN PATENT DOCUMENTS

| | | | |
|---|---|---|---|
| 0367748 | 4/1921 | Fed. Rep. of Germany | 272/142 |
| 0358494 | 3/1906 | France | 272/142 |

*Primary Examiner*—Richard J. Apley
*Assistant Examiner*—L. Thomas
*Attorney, Agent, or Firm*—Charles S. Knothe

[57] ABSTRACT

An exercise device to be used while walking which has a back foundation plate with a plurality of belt loops attached to the back foundation plate; to which a belt with two ends are attached. The belts have a means of attaching one end to another. The back foundation plate contains a plurality of flanges to which an extension pole is removably affixed. The extension pole extends down from the back foundation plate. The length of the extension pole can be adjusted. At the end of the extension pole is a clasp to which a plurality of leg elastic resistance devices are removably attached. The elastic resistance devices are attached to an ankle collar by means of ankle collar clasps. The ankle collars have two ends and a means of connecting the ends of ankle collars to one another. A plurality of accessory hooks are attached to the back foundation plate to which arm elastic resistance devices are attached.

25 Claims, 5 Drawing Sheets

EXERCISE DEVICE FOR RESISTANCE WALKING

BACKGROUND OF INVENTION

America has become concerned with fitness. Medical personnel recommend exercise as part of proper living for a longer, healthier life. Running was a favored form of cardio-vascular exercise but many people received injuries to their feet, ankles, knees, hips and other parts of their skeletal system. Because of these injuries walking has now become the favored exercise. Walking is a much lower impact exercise and the exerciser does not receive the injuries that running can cause. But for the same effect as running walking takes much more time. Therefore, many exercisers have turned to walking with some type of load factor such as ankle weight, vest, dumbbells, etc.

This invention is for the exerciser who wants to add resistance to his walking to exercise his legs and at the same time exercise his arms. With this invention the exerciser can enhance the benefits of walking without the injurious impact to the skeletal system that running causes. One benefit is that more aerobic exercise is achieved in less time. Further, the exerciser can exercise their arms. Thus at one time the exerciser can obtain total exercise of his body. The resistance force for both the arms and the legs can be adjusted to increase the resistance to build up the strength of the exerciser, (i.e. progressive exercise program) and adjustment allows for a universal device adaptable to all walkers.

Further the device is design so that the exerciser can use either the leg exerciser or the arm exerciser independently or both as the need be.

SUMMARY OF THE INVENTION

This invention discloses an exercise device to be used while walking which has a back foundation plate with a plurality of belt loops attached to the back foundation plate to which a belt with two ends are attached. The belts have a means of attaching one end to another. The back foundation plate contains a plurality of flanges to which an extension pole is permanently or removably affixed. The extension pole extends down and outward from the back foundation plate. The length of the extension pole can be adjusted. At the end of the extension pole is a clasp or an adjustable width spreader bar with a clasp at each end to which a plurality of leg resistance devices are removably attached. The leg resistance devices can be elastic cords, springs or cable, pulley and brake device. The resistance devices are attached to an ankle collar by means of ankle collar clasps. The ankle collars have two ends and a means of connecting the ends of ankle collars to one another. The resistance devices can also be connected to a loop on the back of the shoe. A plurality of accessory hooks are attached to the back foundation plate to which arm elastic resistance devices are attached.

BRIEF DESCRIPTION OF THE DRAWING

The present invention is illustrated in detail according to the accompanying drawings as follows.

DESCRIPTION OF THE PREFERRED EMBODIMENT IN THE DRAWINGS

Figure 1:
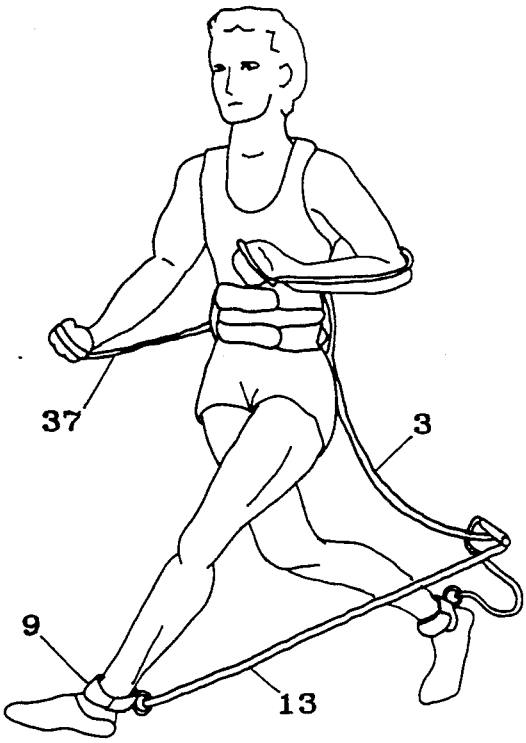
FIG. 1 is a perspective drawing of the device being used by an exerciser using both the leg and arm exercise provisions.

In FIG. 1 the exerciser is using the device. The extension pole 3 is located at the rear of the exerciser with the leg elastic resistance devices 13 attached to the ankle collars 9. The leg elastic resistance devices increase the effort necessary to walk thus giving the exerciser more benefit while walking. Further, this figure shows the arm elastic resistance device 37. The exerciser can push his arms out forward or upward or a combination of both, forcing against the resistance. Also, the exerciser can slowly let the arm elastic resistance device return to is natural length, exercising different muscles.

Figure 2A:
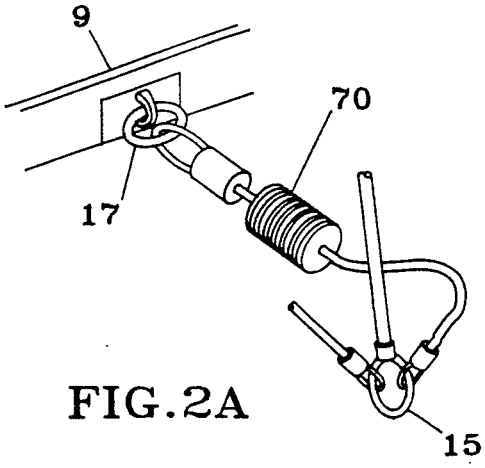
FIG. 2A is a fragmentary view showing the coil tension spring attached to the extension pole at one end and the ankle collar at the other end.
Figure 2:
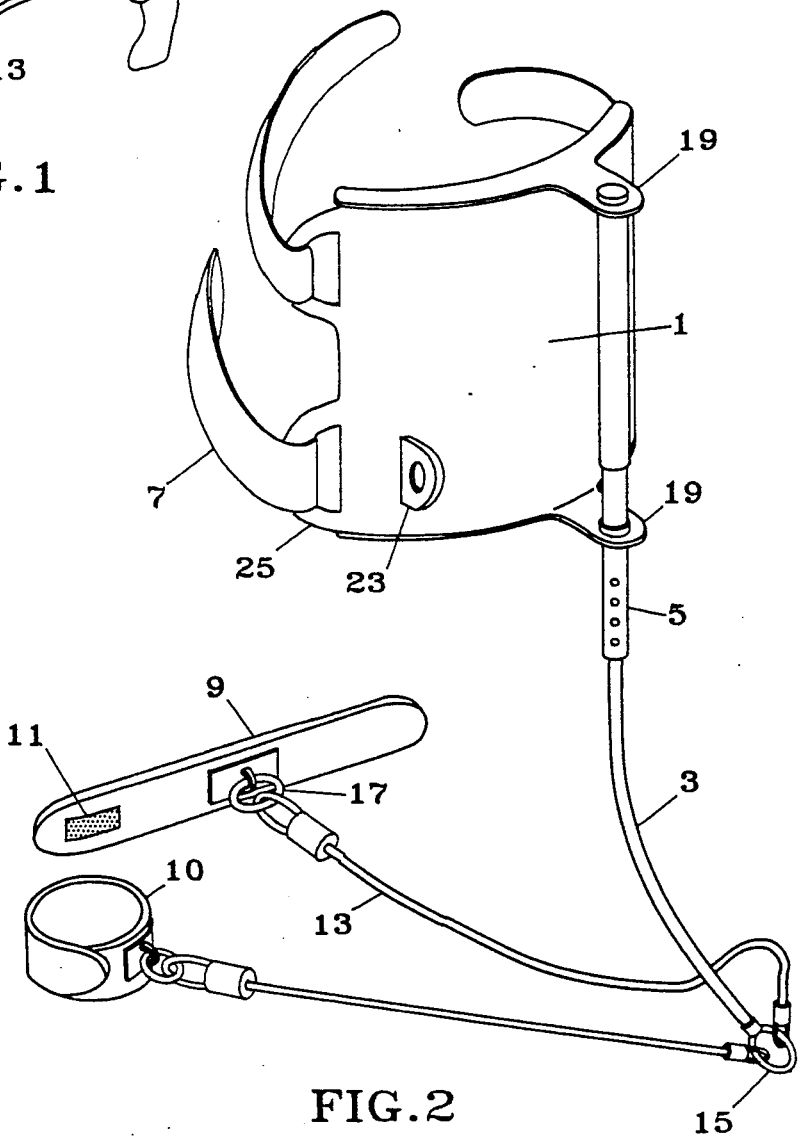
FIG. 2 is a perspective drawing of the device from the side showing the extension pole, the leg elastic resistance devices, and ankle collars. front showing the pockets and accessory hooks mounted on the back foundation plate.

The back foundation plate 1 is shown in FIG. 2. The back foundation plate is molded in a shape to the contours of the back of the exerciser with a curve around the rib cage and a curve along the back. The inside surface of the back foundation plate is padded using a foam padding substance. This padding makes the wearing of the back foundation plate comfortable. The extension pole 3 is removably attached to the foundation plate at the flanges 19. The flanges 19 are reinforced and additional material is molded at these areas to accept the greater stress that the extension pole exerts on the back foundation plate. The ability to remove the extension pole allows easier storage of the device and the packing of the device for the exerciser who travels. The belts 7 are attached to the back foundation plate at the belt loops 25. The extension pole 3 extends downward and away from the exerciser. It is important that the extension pole does not interfere with the exerciser as he walks or else the exerciser may trip. The length of the extension pole 3 can be adjusted. The pole consists of two segments with one segment telescoping within the other and the length being fixed by a commonly used pop pin and hole mechanism as shown by item 5 in FIG. 2.

In FIG. 2 the leg elastic resistance devices 13 are connected to the loop 15 at the end of the extension pole 3. These leg elastic resistance devices can be elastic, cords or springs as are commonly used in exercise equipment. Various modulus of elasticity can be used allowing the exerciser the ability to change the resistance, thus making it easy for the beginner and more strenuous for the advanced exerciser. The ankle collars 9 are attached to the ends of the leg elastic resistance devices by the ankle collar clasps 17. In the preferred embodiment the two ends of the ankle collars are connected together by hook 10 and loop 11 fastener device which is currently used in much exercise equipment. This type of fastener allows for quick coupling and uncoupling and almost unlimited size adjustment. But other types of fasteners such as buckle and belt may also be utilized. The ankle collar 9 is shown with the two ends connected as it would be used around the ankle of the exerciser. The interior surfaces of the ankle collar are padded with a foam material or other suitable padding material.

Figure 3:
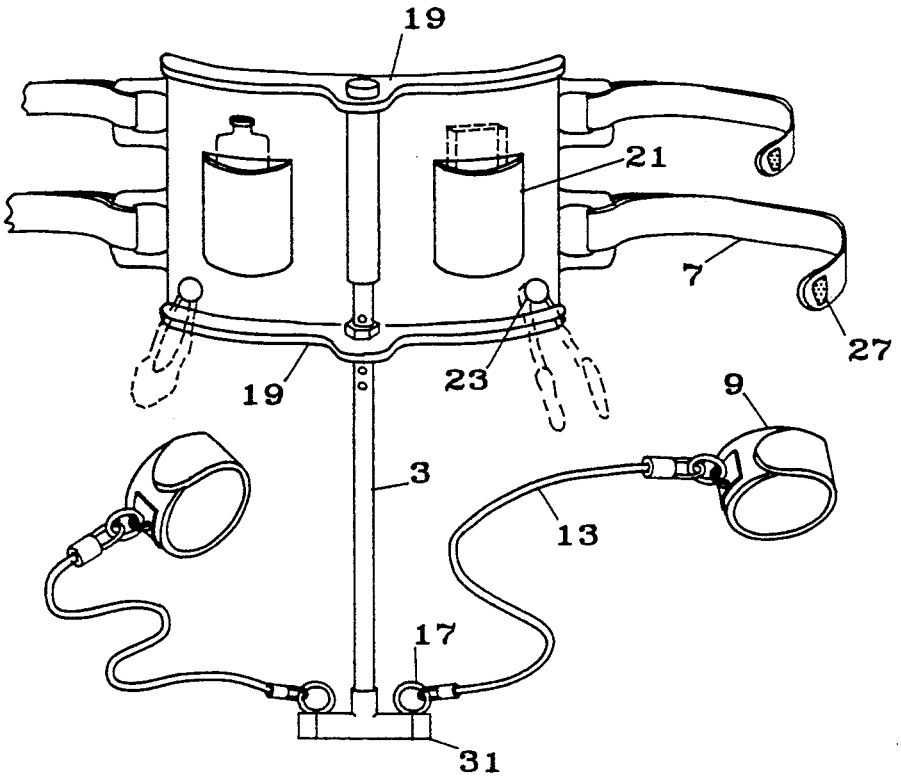
FIG. 3 is a perspective drawing of the device from the front showing the pockets and accessory hooks mounted on the back foundation plate.
Figure 13:
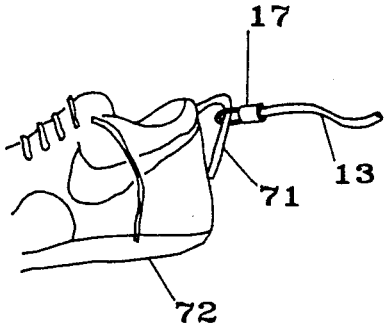
FIG. 13 is a fragmentary view of the elastic resistance device attached to a loop affixed to the shoe.

The pocket 21 is shown in FIG. 3. This pocket is molded into the surface of the back foundation plate. The pocket can be used by the exerciser to hold items such as a water bottle (as shown in phantom), towel, radio, or tape player. FIG. 3 also shows the accessory hook 23. The belts 7 are connected to one another by use of a hook and loop device 27. This allows quick and easy donning of the device and infinite adjustment for better comfort. The extension pole 3 is removable; attached to the back foundation plate at the flanges 19. The leg elastic resistance devices 13 are connected at 17 to the end of the adjustable width spreader bar 31 which is connected to the extension pole 3. The other end of the leg elastic resistance devices 13 are connected to the ankle collar 19 or a loop on the footwear as shown in FIG. 13.

Figure 4:
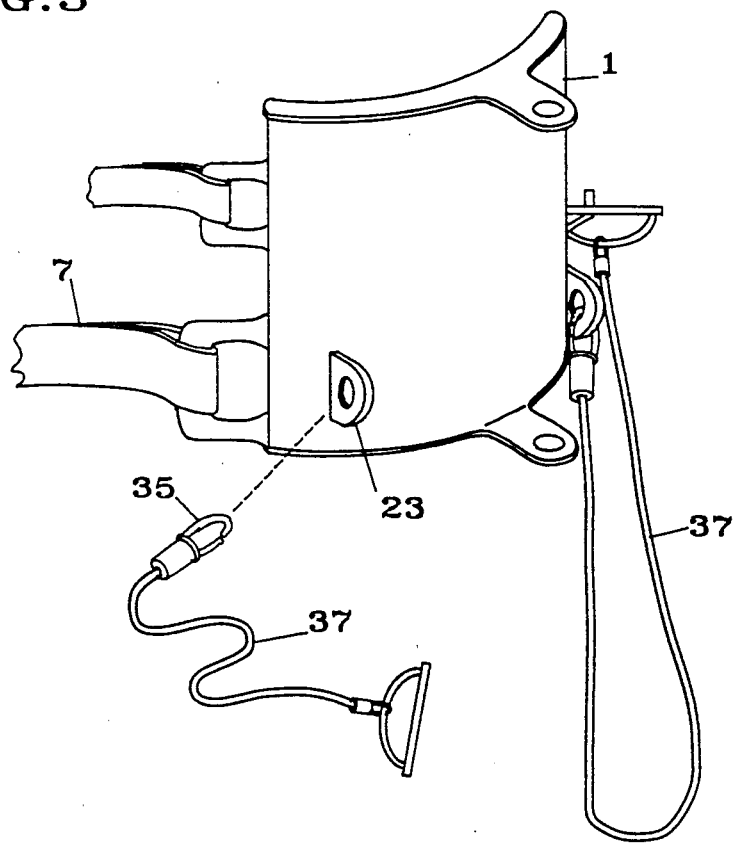
FIG. 4 is a partial perspective drawing showing the location of the arm exercise device.

In FIG. 4 the arm elastic resistance device 37 is attached to the back foundation plate 1 at the accessory hook 23 by means of the clasp 35. In the preferred embodiment two arm elastic devices are used. The exerciser can use these while resistance walking giving the exerciser the ability to exercise the upper torso body muscles simultaneously with the leg muscles.

Figure 5:
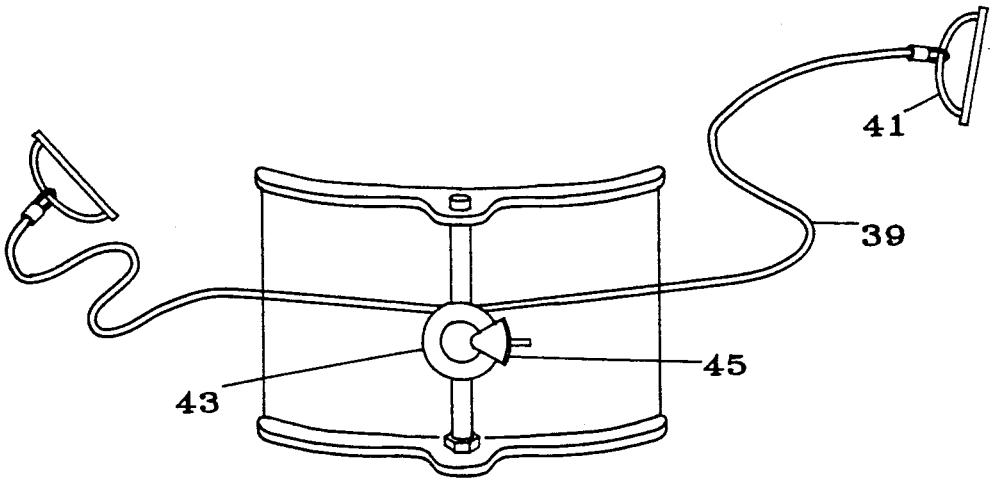
FIG. 5 is a partial perspective drawing of the optional arm exercise device using a cable, pulley and brake device.

FIG. 5 depicts an alternate method for the arm resistance device. Rather than using an elastic member, a cable, pulley and brake can be used, as is commonly available for exercise equipment. The brake allows the exerciser variable resistance as the user's ability changes. The handle 41 is connected to a flexible cable 39 which passes around the pulley 43 to the other end of the cable 39 with another handle. The rotation of the pulley 43 is controlled by adjusting the brake 45.

Figure 6:
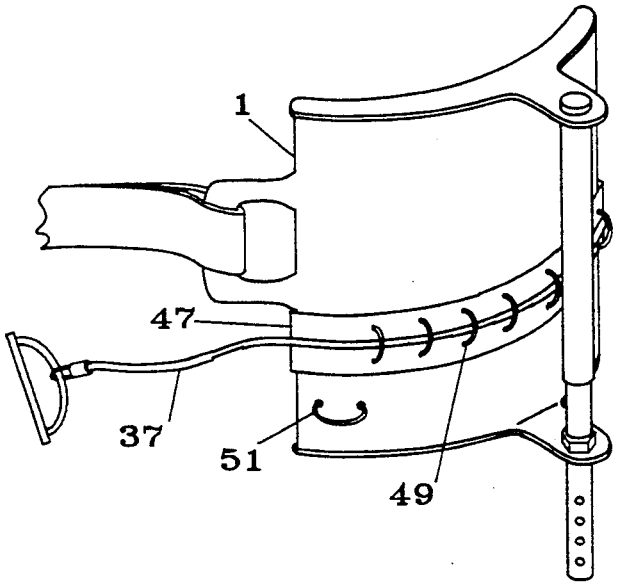
FIG. 6 is a perspective drawing of the removable arm exercise device attached to the back foundation plate.

FIG. 6 shows yet another alternate method for the arm resistance device. Here belt 45 is connected to the back foundation plate 1. The belt contains a plurality of belt loops 49 through which the elastic resistance member 37 passes. The exerciser gasps the handles attached to the end of the elastic resistance member and pulls. This method allows for the use of the arm resistance device independently from the leg exercise portion of this invention.

Figure 7:
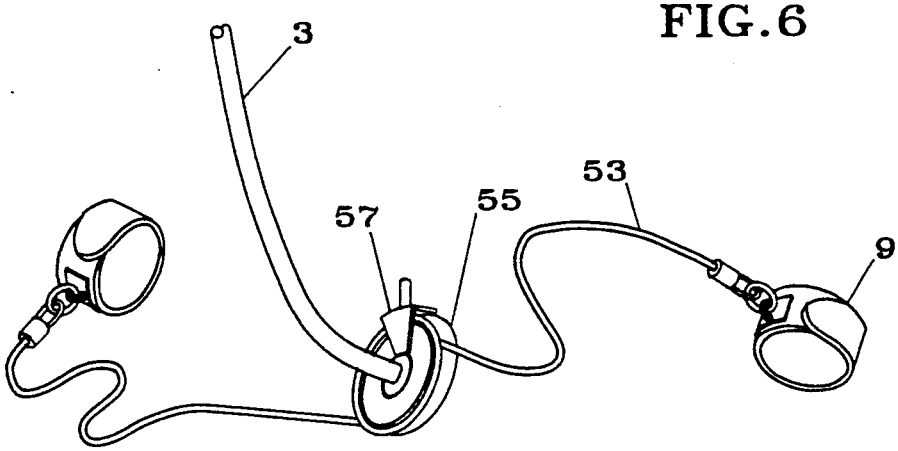
FIG. 7 is a partial perspective drawing of the optional leg exercise device using a cable, pulley and brake device.

An alternative method for the leg resistance means is shown in FIG. 7. Connected to the end of the extension pole 3 is a cable 53, pulley 55 and brake device 57. The exerciser straps the ankle collars 9 to his legs.

Figure 8:
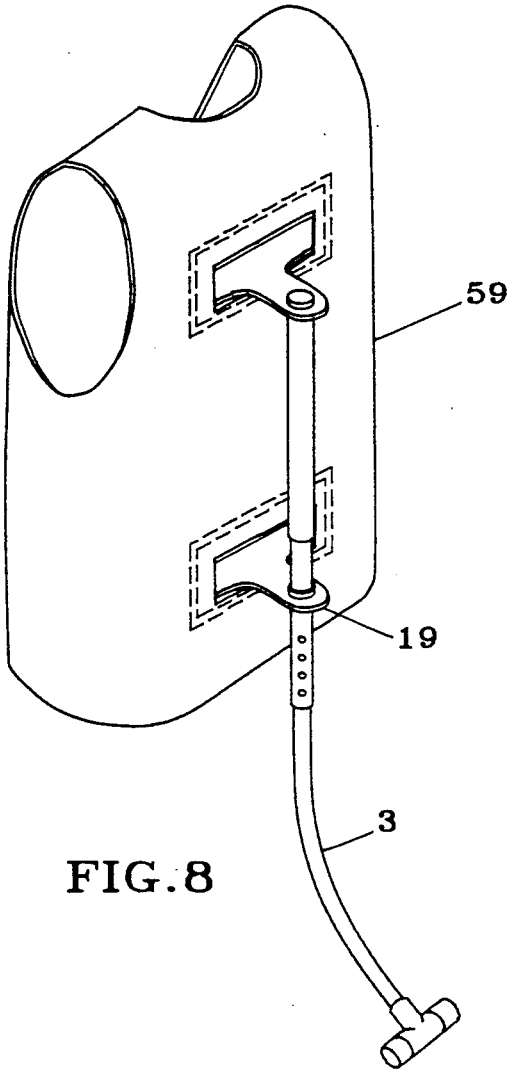
FIG. 8 is a perspective drawing of the device permanently attached to a vest as the means of wearing it.
Figure 9:
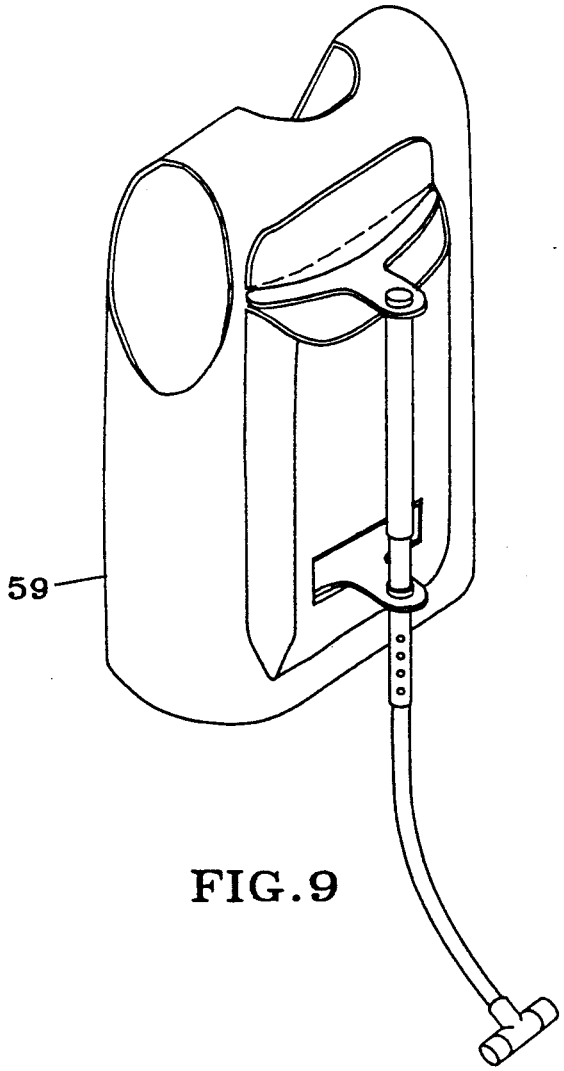
FIG. 9 is a perspective drawing of the device removably attached to a vest as the means of wearing it.
Figure 10:
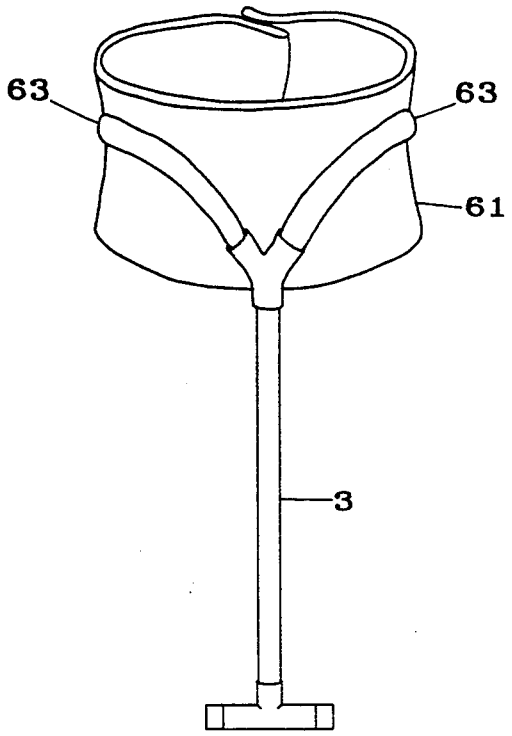
FIG. 10 is a perspective drawing of the device removably attached to a belt as the means of wearing it.
Figure 11:
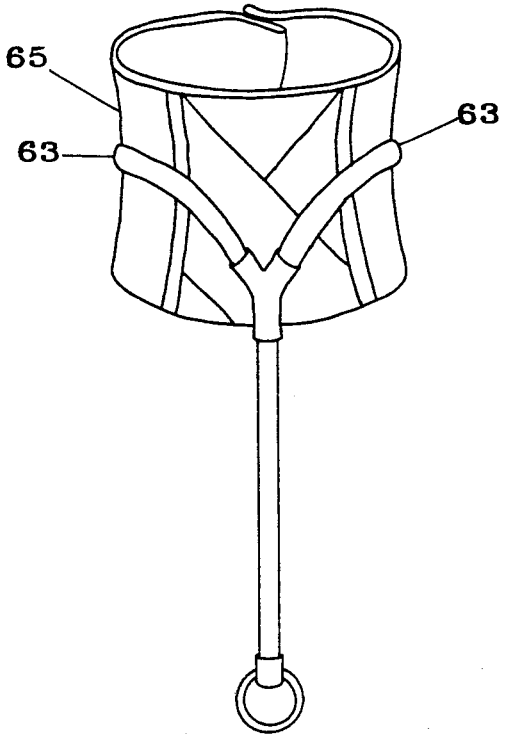
FIG. 11 is a perspective drawing of the device removably attached to a corset as the means of wearing it.
Figure 12:
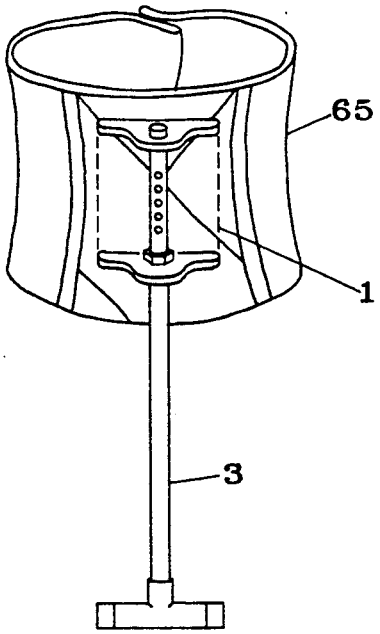
FIG. 12 is a perspective drawing of the device permanently attached to a corset as the means of wearing it.

FIGS. 8 and 9 show the use of a vest 59 rather than the belts. The vest in FIG. 8 is not removable from the device and the vest in FIG. 9 is removable from the device. FIG. 11 shows the device using a belt 61. The extension pole 3 is connected to a plurality of side attachment units 63 which are attached to the belt 61. FIG. 12 shows the device using a corset 65. Here the extension pole is attached to the corset by means of the side attachment units 63. Finally FIG. 12 shows the device using a corset with the foundation plate 1 attached to the corset 65.

I claim:

1. An exercise device to be used while walking which comprises:

a back foundation plate;

a plurality of belt loops attached to the back foundation plate;

a belt with two ends attached to the belt loop;

a means of attaching the belt ends to one another;

a plurality of flanges attached to the back foundation plate;

an extension pole removably affixed to the back foundation plate at the flanges and with one end extending down from the back foundation plate;

a means to adjust the length of the extension pole; a clasp attached to the end of the extension pole which is farthest from the back foundation plate;

a plurality of leg elastic resistance devices with one end removably attached to the clasp;

a plurality of ankle collar clasps removably attached to the leg elastic resistance device;

a plurality of ankle collars with two ends to which the ankle collar clasps are affixed;

a means of connecting the ends of ankle collars to one another.

2. The device as in claim 1 wherein the means to adjust the length of the pole is a pole with two segments, one segment telescoping within the other and the length being determined by a pop pin interacting with holes in the segments.

3. The device as in claim 1 wherein the leg elastic resistance devices are replaced with a cable, pulley and brake device.

4. The device as in claim 1 wherein the plurality of belt loops attached to the back foundation plate, the belt with two ends attached to the belt loop and the means of attaching the belt ends to one another are replaced with a vest to which the back foundation plate is permanently attached.

5. The device as in claim 1 wherein the plurality of belt loops attached to the back foundation plate, the belt with two ends attached to the belt loop and the means of attaching the belt ends to one another are replaced with a vest to which the back foundation plate is removably attached.

6. The device as in claim 1 wherein the extension pole is permanently affixed to the back foundation plate.

7. The device as in claim 1 wherein the leg elastic resistance devices are replaced with coil tension springs.

8. The device as in claim 1 wherein the leg elastic resistance devices are replaced with elastic cords.

9. The device as in claim 1 wherein at the end of the extension pole there is an adjustable width spreader bar with a clasp at each end to which the elastic resistance members are attached.

10. The device as in claim 1 wherein the foundation plate, the plurality of belt loops attached to the back foundation plate, the belt with two ends attached to the belt loop and the means of attaching the belt ends to one another are replaced with a belt with a plurality of side attachment units affixed to the belt and the extension pole affixed to the side attachment units.

11. The device as in claim 1 wherein the foundation plate, the plurality of belt loops attached to the back foundation plate, the belt with two ends attached to the belt loop and the means of attaching the belt ends to one another are replaced with a corset with a plurality of side attachment units affixed to the belt and the extension pole affixed to the side attachment units.

12. The device as in claim 1 wherein the plurality of belt loops attached to the back foundation plate, the belt with two ends attached to the belt loop and the means of attaching the belt ends to one another are replaced with a corset to which the back foundation plate is permanently attached.

13. The device as in claim 1 wherein there is an adjustable width spreader bar at the end of the extension pole to which the elastic resistance members are attached.

14. The device as in claim 1 wherein the leg resistance devices are attached at one end to a loop affixed to a shoe.

15. An exercise device to be used while walking which comprises:

a back foundation plate;

a plurality of belt loops attached to the back foundation plate;

a belt with two ends attached to the belt loop;

a means of attaching the belt ends to one another;

a plurality of flanges attached to the back foundation plate;

an extension pole removably affixed to the back foundation plate at the flanges and with one end extending down from the back foundation plate;

a means to adjust the length of the extension pole;

a clasp attached to the end of the extension pole which is farthest from the back foundation plate;

a plurality of leg elastic resistance devices with one end removably attached to the clasp;

a plurality of ankle collar clasps removably attached to the leg elastic resistance device;

a plurality of ankle collars with two ends to which the ankle collar clasps are affixed;

a means of connecting the ends of ankle collars to one another;

a plurality of accessory hooks attached to the back foundation plate;

a plurality of arm elastic resistance devices;

an arm exerciser clasp attached to one end of the arm elastic resistance device and interconnecting with the accessory hooks on the back foundation plate;

a handle attached to the end of the elastic resistance device.

16. The device as in claim 15 wherein the means to adjust the length of the pole is a pole with two segments, one segment telescoping within the other and the length being determined by a pop pin interacting with holes in the segments.

17. The device as in claim 15 wherein the arm elastic resistance devices are replaced with a cable, pulley and brake device.

18. The device as in claim 15 wherein the arm elastic resistance devices are replaced with a belt which is removably attached to the back foundation plate and contains a plurality of loops through which an elastic resistance member passes and has a handle at each end of the elastic member.

19. The device as in claim 15 wherein the plurality of belt loops attached to the back foundation plate, the belt with two ends attached to the belt loop and the means of attaching the belt ends to one another are replaced with a vest to which the back foundation plate is permanently attached.

20. The device as in claim 15 wherein the plurality of belt loops attached to the back foundation plate, the belt with two ends attached to the belt loop and the means of attaching the belt ends to one another are replaced with a vest to which the back foundation plate is removably attached.

21. The device as in claim 15 wherein the extension pole is permanently affixed to the back foundation plate.

22. The device as in claim 15 wherein the leg elastic resistance devices are replaced with coil tension springs.

23. The device as in claim 15 wherein the leg elastic resistance devices are replaced with elastic cords.

24. The device as in claim 15 wherein there is an adjustable width spreader bar at the end of the extension pole to which the elastic resistance members are attached.

25. The device as in claim 15 wherein the leg resistance devices are attached at one end to a loop affixed to a shoe.

* * * * *